US012319525B2

(12) United States Patent
Kurusu et al.

(10) Patent No.: US 12,319,525 B2
(45) Date of Patent: Jun. 3, 2025

(54) SHEET FEEDING DEVICE AND IMAGE FORMING APPARATUS INCORPORATING THE SHEET FEEDING DEVICE

(71) Applicants: Yuka Kurusu, Kanagawa (JP); Yoshifumi Ohtsuka, Kanagawa (JP); Masato Hashimoto, Kanagawa (JP); Hisayoshi Sugawara, Kanagawa (JP); Kazunori Konno, Kanagawa (JP)

(72) Inventors: Yuka Kurusu, Kanagawa (JP); Yoshifumi Ohtsuka, Kanagawa (JP); Masato Hashimoto, Kanagawa (JP); Hisayoshi Sugawara, Kanagawa (JP); Kazunori Konno, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 177 days.

(21) Appl. No.: 18/175,966

(22) Filed: Feb. 28, 2023

(65) Prior Publication Data

US 2023/0278817 A1 Sep. 7, 2023

(30) Foreign Application Priority Data

Mar. 1, 2022 (JP) ..... 2022-030810

(51) Int. Cl.
*B65H 1/04* (2006.01)
*B65H 1/06* (2006.01)
(Continued)

(52) U.S. Cl.
CPC ..... *B65H 1/04* (2013.01); *B65H 1/06* (2013.01); *B65H 1/266* (2013.01); *B65H 3/0684* (2013.01); *B65H 2402/32* (2013.01); *B65H 2404/1521* (2013.01); *B65H 2405/11164* (2013.01); *B65H 2511/11* (2013.01)

(58) Field of Classification Search
CPC ... B65H 1/04; B65H 1/08; B65H 1/12; B65H 1/266; B65H 2402/30; B65H 2402/32; B65H 2402/40; B65H 2405/1116; B65H 2405/11164; B65H 2405/111646;
(Continued)

(56) References Cited

U.S. PATENT DOCUMENTS 10,934,115 B2 * 3/2021 Yazawa ..... B65H 1/266
2006/0082044 A1 * 4/2006 Aida ..... B65H 1/04 271/145

(Continued)

FOREIGN PATENT DOCUMENTS

JP 2010-202372 9/2010
JP 2022-063726 4/2022

*Primary Examiner* — Prasad V Gokhale
(74) *Attorney, Agent, or Firm* — Harness, Dickey & Pierce, P.L.C.

(57) ABSTRACT

A sheet feeding device includes a sheet tray, an extended bottom plate, a casing, and a support. The sheet tray includes a bottom plate and feeds a sheet placed on the bottom plate, toward an image forming apparatus. The extended bottom plate extends outward from the sheet feeding device and is coupled to an upstream end of the bottom plate of the sheet tray in a sheet conveyance direction in which the sheet is conveyed. The casing is attached to a side face of the sheet feeding device to cover the extended bottom plate. The support is disposed between an inner wall face of the casing and the extended bottom plate to support a weight load of the extended bottom plate.

13 Claims, 8 Drawing Sheets

(51) Int. Cl.
*B65H 1/26* (2006.01)
*B65H 3/06* (2006.01)

(58) Field of Classification Search
CPC ..... B65H 2405/1117; B65H 2405/115; B65H 2405/324; B65H 2511/11
See application file for complete search history.

(56) References Cited

U.S. PATENT DOCUMENTS

2021/0061592 A1* 3/2021 Ikeda ..... B65H 1/266
2022/0082978 A1* 3/2022 Maeda ..... B65H 1/14

* cited by examiner

SHEET FEEDING DEVICE AND IMAGE FORMING APPARATUS INCORPORATING THE SHEET FEEDING DEVICE

CROSS-REFERENCE TO RELATED APPLICATION

This patent application is based on and claims priority pursuant to 35 U.S.C. § 119(a) to Japanese Patent Application No. 2022-030810, filed on Mar. 1, 2022, in the Japan Patent Office, the entire disclosure of which is hereby incorporated by reference herein.

BACKGROUND

Technical Field

Embodiments of the present disclosure relate to a sheet feeding device including an extended bottom plate vertically movable on the outside of the sheet feeding device, and an image forming apparatus incorporating the sheet feeding device.

Background Art

Various types of image forming apparatuses such as copiers, facsimile machines, and printers include a sheet feeding device that accommodates a stack of sheet materials such as recording sheets or media. The sheet feeding device includes a plurality of kinds of sheet trays corresponding to respective sizes of sheet materials.

A known sheet feeding device includes a regular sheet tray provided with a bottom plate. To accommodate a long sheet as well as a regular sheet, an extended bottom plate is coupled to the bottom plate of the regular sheet tray.

The extended bottom plate is attached protruding outward from the known sheet feeding device. A support is employed to support the extended bottom plate from below to prevent warp or inclination of the extended bottom plate.

SUMMARY

Embodiments of the present disclosure described herein provide a novel sheet feeding device including a sheet tray, an extended bottom plate, a casing, and a support. The sheet tray includes a bottom plate and feeds a sheet placed on the bottom plate, toward an image forming apparatus. The extended bottom plate extends outward from the sheet feeding device and is coupled to an upstream end of the bottom plate of the sheet tray in a sheet conveyance direction in which the sheet is conveyed. The casing is attached to a side face of the sheet feeding device to cover the extended bottom plate. The support is disposed between an inner wall face of the casing and the extended bottom plate to support a weight load of the extended bottom plate.

Further, embodiments of the present disclosure described herein provide an image forming apparatus including the above-described.

BRIEF DESCRIPTION OF THE SEVERAL VIEWS OF THE DRAWINGS

Exemplary embodiments of this disclosure will be described in detail based on the following figures, wherein.

Figure 1:
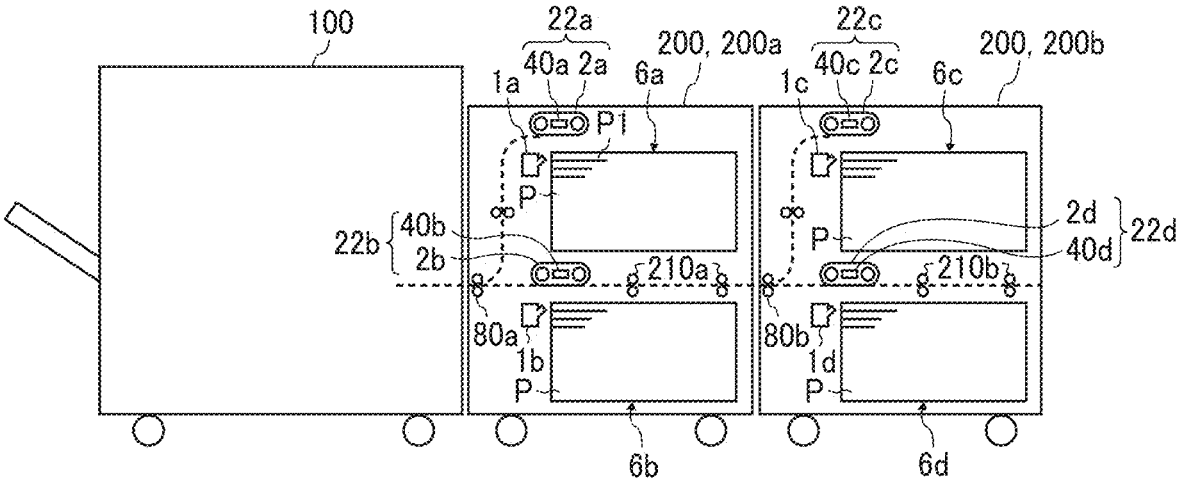
FIG. 1 is a schematic side view of a sheet feeding device and an image forming apparatus, according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

It will be understood that if an element or layer is referred to as being "on," "against," "connected to" or "coupled to" another element or layer, then it can be directly on, against, connected or coupled to the other element or layer, or intervening elements or layers may be present. In contrast, if an element is referred to as being "directly on," "directly connected to" or "directly coupled to" another element or layer, then there are no intervening elements or layers present. As used herein, the term "connected/coupled" includes both direct connections and connections in which there are one or more intermediate connecting elements. Like numbers refer to like elements throughout. As used herein, the term "and/or" includes any and all combinations of one or more of the associated listed items.

Spatially relative terms, such as "beneath," "below," "lower," "above," "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

The terminology used herein is for describing particular embodiments and examples and is not intended to be limiting of exemplary embodiments of this disclosure. As used herein, the singular forms "a," "an," and "the" are intended to include the plural forms as well, unless the context clearly indicates otherwise. It will be further understood that the terms "includes" and/or "including," when used in this specification, specify the presence of stated features, integers, steps, operations, elements, and/or components, but do not preclude the presence or addition of one or more other features, integers, steps, operations, elements, components, and/or groups thereof.

Referring now to the drawings, embodiments of the present disclosure are described below. In the drawings for explaining the following embodiments, the same reference codes are allocated to elements (members or components) having the same function or shape and redundant descriptions thereof are omitted below.

Image Forming Apparatus and Sheet Feeding Device

Referring now to the drawings, wherein like reference numerals designate identical or corresponding parts throughout the several views, an image forming apparatus 100 and a sheet feeding device 200 according to embodiments of the present embodiment are described in detail below. Note that elements (for example, mechanical parts and components) having the same functions and shapes are denoted by the same reference numerals throughout the specification and redundant descriptions are omitted.

FIG. 1 is a schematic side view of a sheet feeding device 200 and an image forming apparatus 100, according to an embodiment of the present disclosure.

To be more specific, FIG. 1 illustrates the image forming apparatus 100 and two sheet feeding devices 200 (i.e., a first sheet feeding devices 200*a* and a second sheet feeding device 200*b*) respectively coupled to the image forming apparatus 100. Each of the first sheet feeding device 200*a* and the second sheet feeding device 200*b* feed sheet materials sequentially to the image forming apparatus 100.

Figure 2:
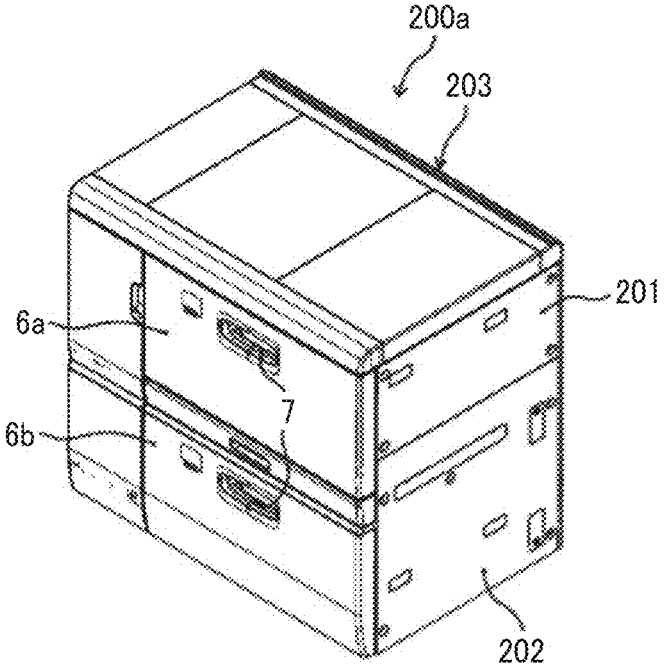
FIG. 2 is a schematic side view of the sheet feeding device of FIG. 1.

FIG. 2 is a schematic side view of the sheet feeding device of FIG. 1.

To be more specific, FIG. 2 illustrates the exterior of the first sheet feeding device 200*a*. The housing 203 of the first sheet feeding device 200*a* has a box shape as a whole and includes, for example, a frame and a plurality of panels, i.e., an upper panel 201 and a lower panel 202, attached to the frame.

Figure 3:
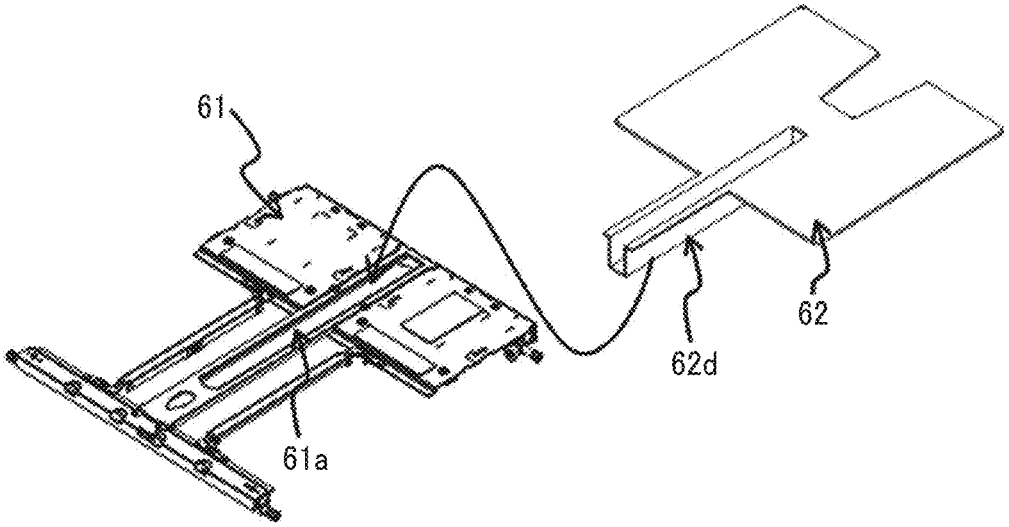
FIG. 3 is a perspective view of a bottom plate and an extended bottom plate of a sheet tray included in the sheet feeding device of FIG. 2.

FIG. 3 is a perspective view of a bottom plate and an extended bottom plate of a sheet tray included in the sheet feeding device of FIG. 2.

The first sheet feeding device 200*a* includes sheet trays 6 (i.e., a sheet tray 6*a* and a sheet tray 6*b*). Each of the sheet trays 6 can be drawn from the housing 203 of the first sheet feeding device 200*a* toward the near side in FIG. 2. When drawing one of the sheet trays 6, the user grabs a handle 7 and pulls the sheet tray 6 to the near side in the FIG. 2, so that the sheet tray 6 can be detached from the first sheet feeding device 200*a*. By drawing the sheet tray 6 out from the first sheet feeding device 200*a*, sheets P can be stacked on the sheet tray 6 or can be removed from the sheet tray 6. Each of the sheet trays 6 (i.e., the sheet tray 6*a* and the sheet tray 6*b*) includes a bottom plate 61 (see FIG. 3) to stack a bundle of sheets P that are sheet materials.

As illustrated in FIG. 1, the sheet feeding device 200 is attached to the side face of the image forming apparatus 100. The sheet feeding device 200 has a configuration capable of coupling a plurality of units. In the sheet feeding device 200 illustrated in FIG. 1, the first sheet feeding device 200*a* is coupled to the second sheet feeding device 200*b* disposed upstream from the first sheet feeding device 200*a* in a sheet conveyance direction in which the sheet P is conveyed.

The upper panel 201 and the lower panel 202 are attached to the upstream end of the housing 203 of the first sheet feeding device 200*a* in the sheet conveyance direction. The upper panel 201 is detachably attached to the housing 203 with screws. Of the sheet feeding devices 200 directly or indirectly coupled to the image forming apparatus 100, the upper panel 201 may be removed from the extreme upstream sheet feeding device 200 coupled at the extreme upstream side in the sheet conveyance direction, so that the bottom plate 61 in the extreme upstream sheet feeding device 200 may be coupled to an extended bottom plate 62 illustrated in FIG. 3.

More specifically, the bottom plate 61 has a groove 61*a* extending in the sheet conveyance direction at the center in the width direction of the bottom plate 61. More specifically, the extended bottom plate 62 has an insertion protrusion 62*d* extending in the sheet conveyance direction. The insertion protrusion 62*d* has a U shape in cross section and is disposed at the center in the widthwise direction of the extended bottom plate 62, on the downstream end in the sheet conveyance direction. To extend the bottom plate 61, the insertion protrusion 62*d* of the extended bottom plate 62 is inserted into the groove 61*a* of the bottom plate 61 as indicated by arrow in FIG. 3, the length of extension is adjusted, and the extended bottom plate 62 is fixed to the bottom plate 61 with screws.

Sheet Tray

The first sheet feeding device 200*a* includes the sheet trays 6*a* and 6*b* and the second sheet feeding device 200*b* includes sheet trays 6*c* and 6*d*. The sheet trays 6*a* and 6*c* are upper sheet trays and the sheet trays 6*b* and 6*d* are lower sheet trays. As illustrated in FIG. 1, suction belts 2*a*, 2*b*, 2*c*, and 2*d* and suction devices 40*a*, 40*b*, 40*c*, and 40*d* are disposed above the sheet trays 6*a*, 6*b*, 6*c*, and 6*d*. The suction belts 2*a*, 2*b*, 2*c*, and 2*d* include respective suction devices 40*a*, 40*b*, 40*c*, and 40*d* within the respective loops to separate and feed the sheet P stacked on the respective sheet trays 6*a*, 6*b*, 6*c*, and 6*d*. In the first sheet feeding device 200*a*, the uppermost sheet placed on top of the bundle of sheets in one of the sheet trays 6*a* and 6*b* is blown and lifted by a corresponding one of air blowing devices 1*a* and 1*b*, attracted to a corresponding one of the suction belts 2*a* and 2*b*, and conveyed toward the image forming apparatus 100.

When the second sheet feeding device 200*b* is connected to the first sheet feeding device 200*a* and a sheet fed from the second sheet feeding device 200*b* is fed to the image forming apparatus 100, the air blowing device 1*b* is stopped and the suction device 40*b*, the suction belt 2*b*, and an upstream sheet conveyance roller pair 210*a* are operated, so that the suction belt 2*b* is defined as a part of the sheet conveyance passage of the sheet fed from the second sheet feeding device 200*b*. Similarly, when a sheet is fed from the second sheet feeding device 200*b* to the first sheet feeding device 200*a*, the air blowing device 1*d* is stopped and the suction device 40*d*, the suction belt 2*d*, and an upstream sheet conveyance roller pair 210*b* are operated, so that the suction belt 2*d* is defined as a part of the sheet conveyance passage of the sheet in the second sheet feeding device 200*b*. The sheets P in the sheet trays 6*a*, 6*b*, 6*c*, and 6*d* are fed to the next step by output roller pairs 80*a* and 80*b* disposed downstream from the sheet trays 6*a*, 6*b*, 6*c*, and 6*d* in the sheet conveyance passage in the sheet conveyance direction in the first sheet feeding device 200*a* and the second sheet feeding device 200*b*.

Sheet Feeding Unit

As illustrated in FIG. 1, sheet feeding units 22*a*, 22*b*, 22*c*, and 22*d* are disposed above the sheet trays 6*a*, 6*b*, 6*c*, and 6*d*. The sheet feeding units 22*a*, 22*b*, 22*c*, and 22*d* includes the suction belts 2*a*, 2*b*, 2*c*, and 2*d* and the suction devices 40*a*, 40*b*, 40*c*, and 40*d*, respectively. The sheet feeding units 22*a*, 22*b*, 22*c*, and 22*d* function as sheet conveyors, each of which picks the uppermost sheet P one by one from the bundle of sheets P stacked on a corresponding one of the sheet trays 6*a*, 6*b*, 6*c*, and 6*d* and feeds the uppermost sheet P toward the image forming apparatus 100. Each of the suction belts 2*a*, 2*b*, 2*c*, and 2*d* has suction holes penetrating the belt in the vertical direction from the front face to the back face. The suction holes are made over the entire area in the circumferential direction of each of the suction belts 2*a*, 2*b*, 2*c*, and 2*d*. As the suction devices 40*a*, 40*b*, 40*c*, and 40*d* generate negative pressure downwardly, the sheet P is attracted to the lower face of each of the suction belts 2*a*, 2*b*, 2*c*, and 2*d*.

Each of the sheet trays 6*a*, 6*b*, 6*c*, and 6*d* includes side fences and an end fence. The side fences are disposed at both ends in the width direction of the sheet trays 6*a*, 6*b*, 6*c*, and 6*d* to guide the side face in the width direction of the bundle of sheets P stacked on the bottom plate 61. The width direction of the bundle of sheets P is the direction orthogonal to the sheet conveyance direction. The end fence is disposed at the upstream side of the bundle of sheets P in the sheet conveyance direction to hold the trailing end of the bundle of sheets P. Each of the side fences has a side air discharging port that functions as an air discharging port from the air blowing device to lift the sheet P in the air and separate the sheet P from the rest of the bundle of sheets P.

The sheet feeding device 200 according to the present embodiment is a center reference to move the two side fences in accordance with the sheet size. Due to such a configuration, air discharged from a center air discharging port can be blown to the center of the sheet P regardless of the sheet size. Air blowing devices 1*a*, 1*b*, 1*c*, and 1*d* are disposed above a sheet stopper immediately below the sheet feeding units 22*a*, 22*b*, 22*c*, and 22*d*. The air blowing devices 1*a*, 1*b*, 1*c*, and 1*d* blow air through the center air discharging port to lift the sheet P in the air and separate the sheet P from the rest of the bundle of sheets P.

The sheet feeding device 200 including the first sheet feeding device 200*a* and the second sheet feeding device 200*b* according to the present embodiment blows air by the air blowing devices 1*a*, 1*b*, 1*c*, and 1*d* such as air blowers, toward the front end and side ends of the bundle of sheet P stacked on the sheet trays 6*a*, 6*b*, 6*c*, and 6*d*, respectively. The air is blown to a space between the sheets P to float the uppermost sheet P1 to the height of the suction belts 2*a*, 2*b*, 2*c*, and 2*d*, and the suction devices 40*a*, 40*b*, 40*c*, and 40*d* generate negative pressure to attract the uppermost sheet P1 to the suction belts 2*a*, 2*b*, 2*c*, and 2*d*.

A belt drive motor is driven while the uppermost sheet P1 is attracted to the suction belts 2*a*, 2*b*, 2*c*, and 2*d*, so that the suction belts 2*a*, 2*b*, 2*c*, and 2*d* rotate endlessly in the clockwise direction in FIG. 1. By so doing, the uppermost sheet P1 is conveyed by the suction belts 2*a*, 2*b*, 2*c*, and 2*d* to the image forming apparatus 100 where image formation is performed on the uppermost sheet P1. The air blowing devices 1*a*, 1*b*, 1*c*, and 1*d* blow air between the adjacent sheets P not only to lift the uppermost sheet P1 in the predetermined vertical direction and but also to separate the sheets P.

First Embodiment

Descriptions are given of the sheet feeding device including an extended bottom plate according to first to sixth embodiments of the present disclosure sequentially.

Figure 4A:
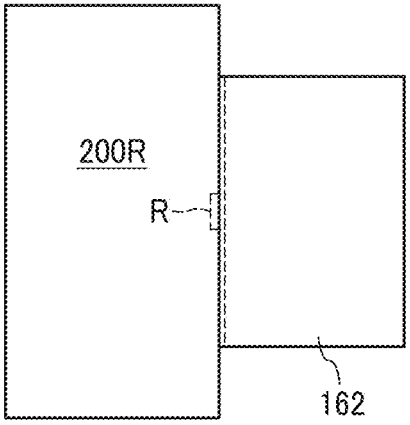
FIG. 4A RELATED ART
FIG. 4A is a diagram illustrating a typical sheet feeding device including a weight load support mechanism of a typical extended bottom plate from below.
Figure 4B:
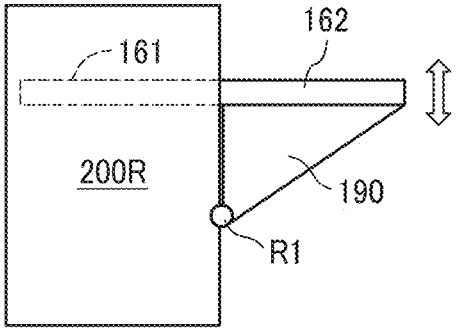
FIG. 4B RELATED ART
FIG. 4B is a side view of the weight load support mechanism of the typical extended bottom plate of the typical sheet feeding device of FIG. 4A.
Figure 4C:
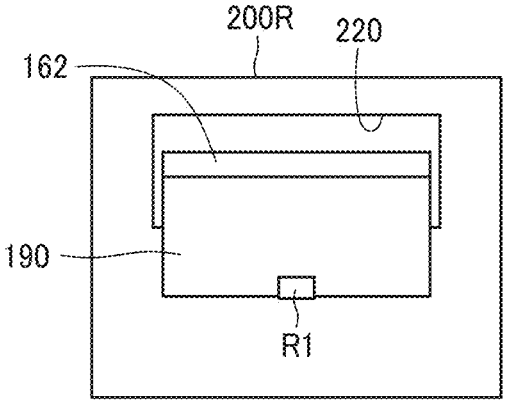
FIG. 4C RELATED ART
FIG. 4C is another side view of the weight load support mechanism of the typical extended bottom plate of the typical sheet feeding device of FIG. 4A.

Here, a description is given of a typical sheet feeding device 200R provided with a typical extended bottom plate, with reference to FIGS. 4A, 4B, and 4C.

FIG. 4A is a diagram illustrating a typical sheet feeding device including a weight load support mechanism of a typical extended bottom plate from below.

FIG. 4B is a side view of the weight load support mechanism of the typical extended bottom plate of the typical sheet feeding device of FIG. 4A.

FIG. 4C is another side view of the weight load support mechanism of the typical extended bottom plate of the typical sheet feeding device of FIG. 4A.

As illustrated in FIGS. 4A, 4B, and 4C, a support 190 is attached to the typical sheet feeding device 200R, below the extended bottom plate 162 attached to the bottom plate 161 and extending from a side opening 220 of the sheet feeding device 200R. With this configuration, the lower end of the support 90 slidingly contacts the side face of the sheet feeding device 200R via a roller R1. With this configuration, the lateral weight load of the roller R1 directly acts on the side face of the sheet feeding device 200R, which causes deflection of the exterior of the sheet feeding device 200R due to the lateral load. When such deflection is generated, the parallelism in vertical movement of the extended bottom plate 162 is not maintained, which is likely to cause sheet feed failure such as no sheet feed and paper jam.

Figure 5A:
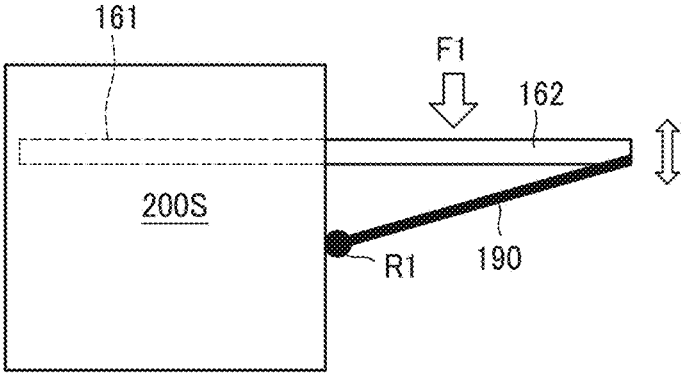
FIG. 5A RELATED ART
FIG. 5A is a schematic side view of another typical sheet feeding device.
Figure 5B:
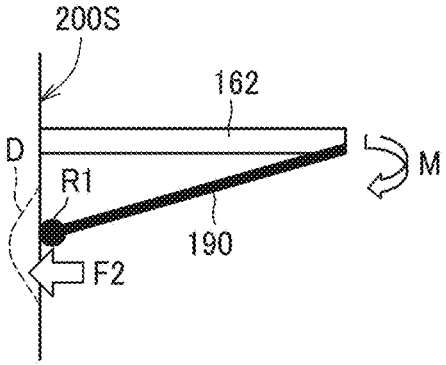
FIG. 5B RELATED ART
FIG. 5B is a diagram illustrating deformation on the side face of the typical sheet feeding device.

Further, since a demand for using long sheets that cannot be accommodated in a normal sheet tray is increasing, a typical sheet feeding device 200S includes the extended bottom plate 162 attached to the bottom plate 161 of the regular sheet tray to accommodate a long sheet, as illustrated in FIGS. 5A and 5B.

FIG. 5A is a schematic side view of another typical sheet feeding device 200S.

FIG. 5B is a diagram illustrating deformation on the side face of the typical sheet feeding device 200S.

The extended bottom plate 162 is attached to the bottom plate 161 and protrudes outward from the side face of the sheet feeding device 200S. When a sheet material is placed on the extended bottom plate 162, the bending moment M to the extended bottom plate 162 increases due to the load F1 of the sheet material, resulting in warp or inclination of the extended bottom plate 162. In order to prevent such inconvenience, a configuration in which a support 190 supports the extended bottom plate 162 from below is typically employed.

However, the exterior of the sheet feeding device 200S is usually made of resin material or a thin sheet metal and is easily deformed. When a vertical slide roller R1 of the support 190 is guided on the side face of the sheet feeding device 200S, the load F2 of the vertical slide roller R1 concentrates at the sliding contact point, and this concentrated weight load tends to cause the deflection D in the exterior of the sheet feeding device 200S. When the deflection D is generated, the parallelism in vertical movement of the extended bottom plate 162 cannot be maintained, which is likely to cause sheet feed failure such as paper jam.

Figure 6A:
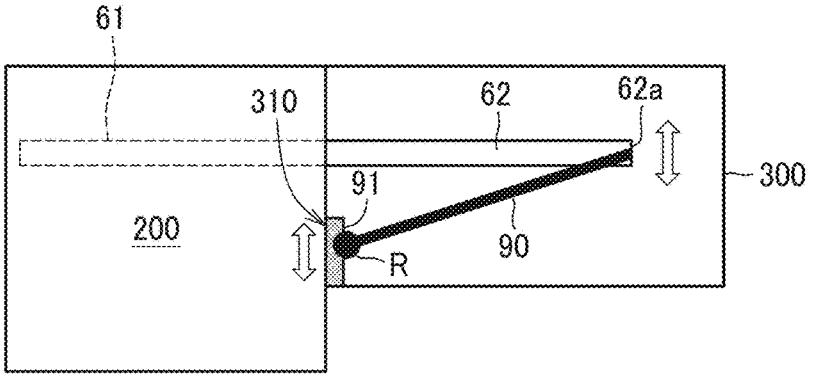
FIG. 6A is a schematic side view of the sheet feeding device and an additional casing, according to a first embodiment of the present disclosure.
Figure 6B:
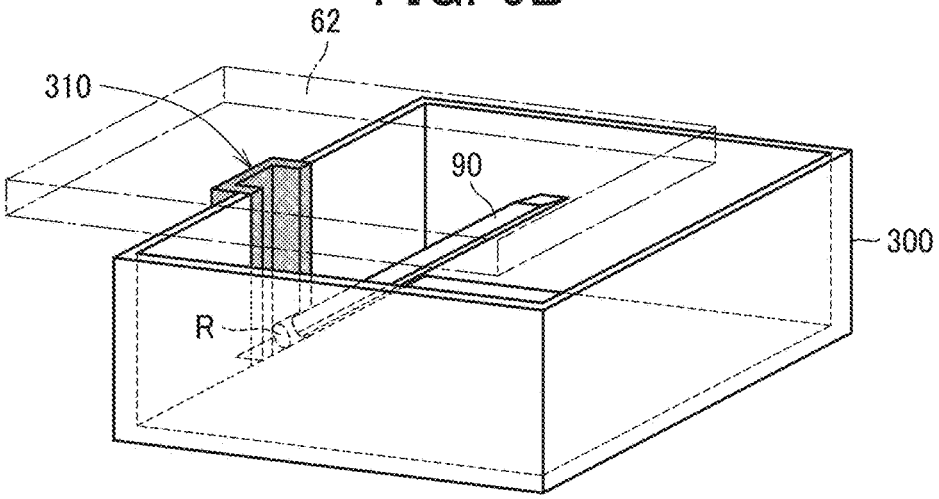
FIG. 6B is a schematic perspective view of the additional casing according to the first embodiment of the present disclosure.

A description is now given of the sheet feeding device 200 according to the first embodiment of the present disclosure, with reference to FIGS. 6A and 6B.

FIG. 6A is a schematic side view of the sheet feeding device 200 and an additional casing 300, according to a first embodiment of the present disclosure.

FIG. 6B is a schematic perspective view of the additional casing 300 according to the first embodiment of the present disclosure.

As illustrated in FIGS. 6A and 6B, the additional casing 300 according to the first embodiment is fixed to the side face of the sheet feeding device 200. The additional casing 300 encloses the entire extended bottom plate 62 extending outward from the sheet feeding device 200. The additional casing 300 is made of a resin material or a metal material, each having a strength that can stably support the weight load of the roller R described below. The dimension of the additional casing 300 (i.e., the length and width of the additional casing 300 in the sheet conveyance direction) is greater than the size of the long sheet to be used in the image forming apparatus 100 and the sheet feeding device 200. The height of the additional casing 300 is set in accordance with the maximum number of sheet materials stacked on the extended bottom plate 62.

In the present embodiment, one end (i.e., the upper end) of the support 90 is fixed to the sheet feeding upstream end 62*a* of the extended bottom plate 62 and the other end (i.e., the lower end) of the support 90 slidably contact to the inner wall face of the additional casing 300, in other words, the front wall face of the additional casing 300 in proximity to the sheet feeding device 200 via the roller R. On the other hand, the one end (i.e., the upper end) of the support 90 may not be fixed to the sheet feeding upstream end 62*a* of the extended bottom plate 62. In other words, the one end (i.e., the upper end) of the support 90 may be fixed to, for example, the intermediate portion in the longitudinal direction of the extended bottom plate 62 that is disposed downstream from the sheet feeding upstream end 62*a* of the extended bottom plate 62 in the sheet conveyance direction.

A recessed gutter 310 is vertically formed on the front wall face of the additional casing 300 in proximity to the sheet feeding device 200. A reinforcement member 91 having high rigidity such as metal is disposed in the recessed gutter 310. The roller R is in contact with the recessed gutter 310 via the reinforcement member 91.

As the extended bottom plate 62 vertically moves, the roller R also vertically moves in the recessed gutter 310 along with the vertical movement of the extended bottom plate 62. At this time, since the roller R vertically moves along the reinforcement member 91, it is not likely to cause deflection in the exterior of the sheet feeding device 200. As a result, the parallelism in vertical movement of the extended bottom plate 62 is maintained.

Second Embodiment

Figure 7A:
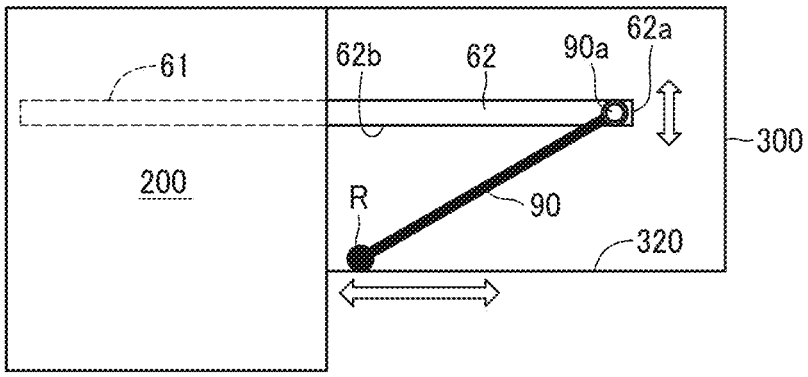
FIG. 7A is a schematic side view of the sheet feeding device and the additional casing, according to a second embodiment of the present disclosure.
Figure 7B:
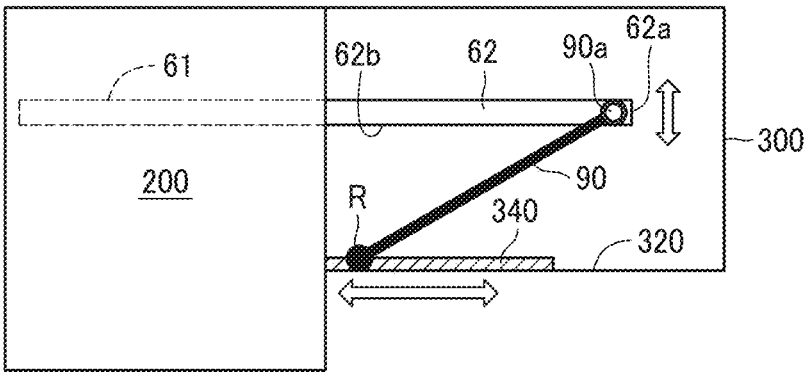
FIG. 7B is a schematic side view of the sheet feeding device and the additional casing, according to the second embodiment of the present disclosure, with a reinforcement member added to the additional casing.

A description is given of the sheet feeding device 200 according to the second embodiment of the present disclosure, with reference to FIGS. 7A and 7B.

FIG. 7A is a schematic side view of the sheet feeding device 200 and the additional casing 300, according to the second embodiment of the present disclosure.

FIG. 7B is a schematic side view of the sheet feeding device 200 and the additional casing 300, according to the second embodiment of the present disclosure, with a reinforcement member 340 added to the additional casing 300.

Figure 8:
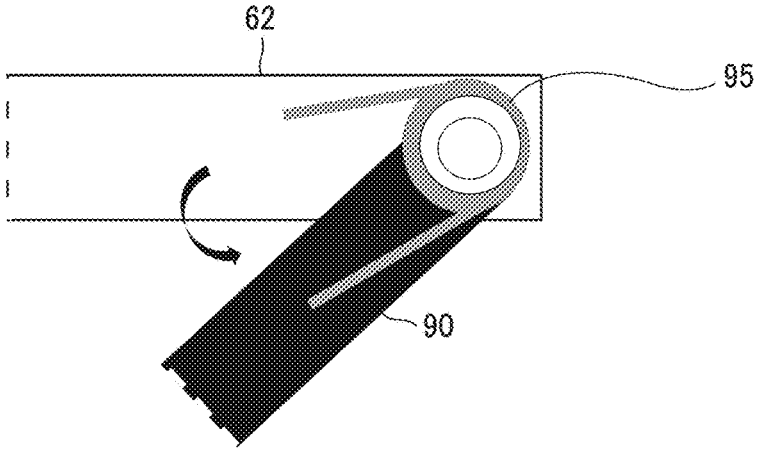
FIG. 8 is a diagram illustrating a torsion spring.

Further, FIG. 8 is a diagram illustrating a torsion spring 95.

As illustrated in FIGS. 7A and 7B, in the second embodiment, the one end (i.e., the upper end) of the support 90 is rotatably coupled to the sheet feeding upstream end 62*a* of the extended bottom plate 62 via a rotary shaft 90*a* of the support 90 and the roller R on the other end (i.e., the lower end) of the support 90 is supported by a bottom face 320 (bottom wall face) of the additional casing 300 below the extended bottom plate 62. In other words, the other end of the support 90 slidably contacts the bottom face 320 of the additional casing 300 via the roller R. The bottom face 320 serving as a sliding face of the roller R is held to be horizontal and has an angle to the extended bottom plate 62 in the vertical direction.

Supporting the roller R by the bottom face 320 can prevent application of extra external force of the support 90 to the extended bottom plate 62. Further, since the one end (i.e., the upper end) of the support 90 is rotatably coupled to the extended bottom plate 62 via the rotary shaft 90*a* of the support 90, the extended bottom plate 62 is prevented from being unparallel due to slight unevenness or inclination of the bottom face 320.

On the other hand, the rotary shaft 90*a* at the one end (i.e., the upper end) of the support 90 may not be fixed to the sheet feeding upstream end 62*a* of the extended bottom plate 62. In other words, the rotary shaft 90*a* at the one end (i.e., the upper end) of the support 90 may be fixed to, for example, the intermediate portion in the longitudinal direction of the extended bottom plate 62 that is disposed downstream from the sheet feeding upstream end 62*a* of the extended bottom plate 62 in the sheet conveyance direction.

A torsion spring 95 (see FIG. 8) is wound around the rotary shaft 90*a* to bias the support 90 in the counterclockwise direction in FIGS. 7A and 7B. As a result, the weight load of the extended bottom plate 62 is held by the reaction force of the roller R pressing the bottom face 320 of the additional casing 300.

When the extended bottom plate 62 vertically moves, the roller R at the lower end of the support 90 slides along the bottom face 320 of the additional casing 300 in the direction indicated by the horizontal arrow as the support 90 changes the angle of inclination. As a result, the parallelism in vertical movement of the extended bottom plate 62 can be maintained.

The additional casing 300 itself has the strength that can stably support the roller R. On the other hand, the additional casing 300 may be provided with a reinforcement member 340 on the bottom face 320, as illustrated in FIG. 7B. Accordingly, the durability of the bottom face 320 can be enhanced.

Third Embodiment

A description is given of the sheet feeding device 200 according to the third embodiment of the present disclosure, with reference to FIGS. 9A, 9B, 9C, and 9D.

Figure 9A:
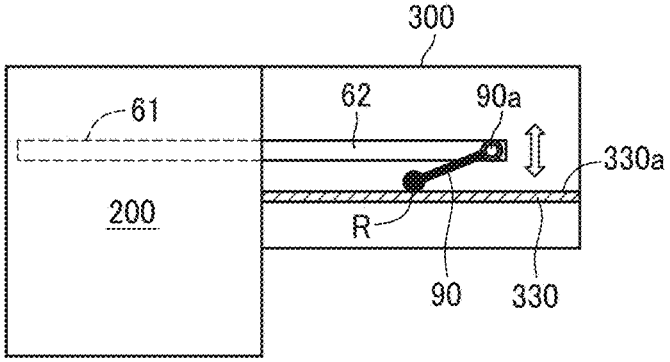
FIG. 9A is a schematic side view of the sheet feeding device and the additional casing, according to a third embodiment of the present disclosure.

FIG. 9A is a schematic side view of the sheet feeding device 200 and the additional casing 300, according to the third embodiment of the present disclosure.

Figure 9B:
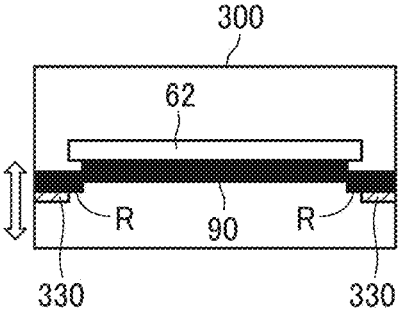
FIG. 9B is a lateral cross-sectional view of the additional casing of FIG. 9A.

FIG. 9B is a lateral cross-sectional view of the additional casing 300 of FIG. 9A.

Figure 9C:
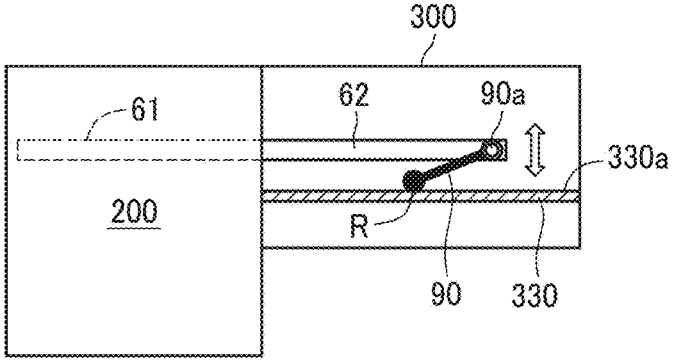
FIG. 9C is a schematic side view of the sheet feeding device and the additional casing, according to the third embodiment of the present disclosure, with a reinforcement member added to the additional casing.

FIG. 9C is a schematic side view of the sheet feeding device 200 and the additional casing 300, according to the third embodiment of the present disclosure, with a reinforcement member 350 added to the additional casing 300.

Figure 9D:
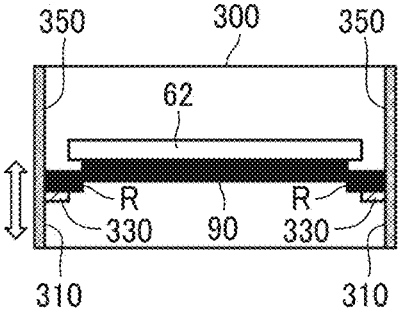
FIG. 9D is a lateral cross-sectional view of the additional casing of FIG. 9C.

FIG. 9D is a lateral cross-sectional view of the additional casing 300 of FIG. 9C.

As illustrated in FIGS. 9A, 9B, 9C, and 9D, the additional casing 300 according to the third embodiment includes supports 330 projecting inward and facing each other and disposed on the inner wall face of the additional casing 300, in other words, on the left and right side walls of the additional casing 300 at both ends of the extended bottom plate 62. The roller R slides on the top face of each of the supports 330. The top face of each of the supports 330 serves as a sliding face of the roller R Supporting the extended bottom plate 62 on the left and right side walls can achieve a space-saving structure of the additional casing 300.

Like FIGS. 7A and 7B, the one end (i.e., the upper end) of the support 90 is rotatably coupled to the sheet feeding upstream end 62*a* of the extended bottom plate 62 via the rotary shaft 90*a*. The other end of the support 90 slidably contacts the faces of the left and right walls of the additional casing 300 disposed facing each other. The torsion spring 95 is wound around the rotary shaft 90*a* to bias the support 90 in the counterclockwise direction in FIGS. 9A and 9C.

As a result, the weight load of the extended bottom plate 62 can be held by the reaction force of the rollers R pressing the support 330 of the additional casing 300. When the extended bottom plate 62 vertically moves, the rollers R at the lower end of the support 90 slides along the support 330 of the additional casing 300 in the horizontal direction as the support 90 changes the angle of inclination. As a result, the parallelism in vertical movement of the extended bottom plate 62 can be maintained.

The left and right walls of the additional casing 300 have the strength that can stably support the rollers R. On the other hand, the additional casing 300 may be provided with a reinforcement member 350 on the left and right walls, as illustrated in FIG. 9D. Accordingly, the durability of the left and right walls of the additional casing 300 can be enhanced.

Fourth Embodiment

Figure 10A:
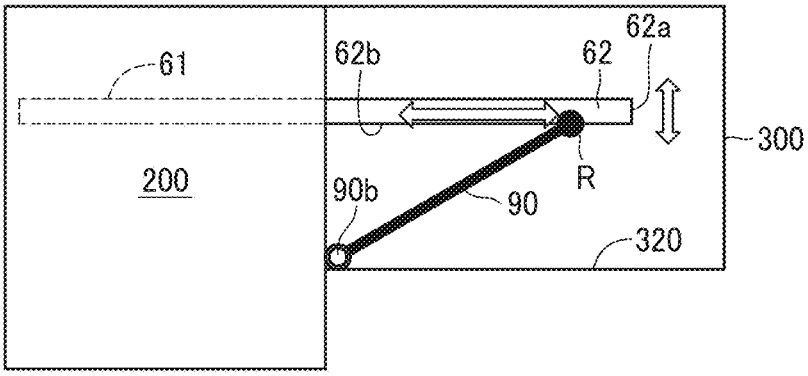
FIG. 10A is a schematic side view of the sheet feeding device and the additional casing, according to a fourth embodiment of the present disclosure.
Figure 10B:
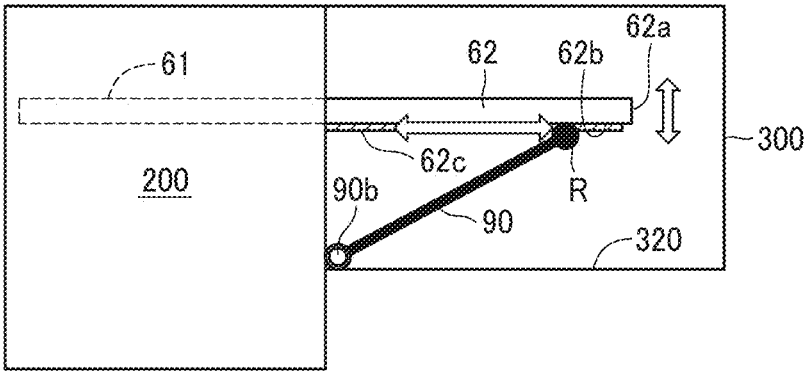
FIG. 10B is a schematic side view of the sheet feeding device and the additional casing, according to the fourth embodiment of the present disclosure, with a reinforcement member added to the extended bottom plate in the additional casing.

A description is given of the sheet feeding device 200 according to the fourth embodiment of the present disclosure, with reference to FIGS. 10A and 10B.

FIG. 10A is a schematic side view of the sheet feeding device 200 and the additional casing 300, according to the fourth embodiment of the present disclosure.

FIG. 10B is a schematic side view of the sheet feeding device 200 and the additional casing 300, according to the fourth embodiment of the present disclosure, with a reinforcement member 62*c* added to the extended bottom plate in the additional casing 300.

As illustrated in FIGS. 10A and 10B, in the fourth embodiment, the roller R slides on a lower face 62*b* of the extended bottom plate 62 to support the weight load of the extended bottom plate 62. In other words, in the present embodiment, one end of the support 90 slidably contacts the lower face 62*b* of the extended bottom plate 62 via the roller R and the other end of the support 90 is coupled to the inner wall face of the additional casing 300, in other words, the front wall face of the additional casing 300 in proximity to the sheet feeding device 200 or the bottom wall of the additional casing 300 below the extended bottom plate 62, via a rotary shaft 90*b*. The lower face 62*b* of the extended bottom plate 62 serves as a sliding face of the roller R. The torsion spring 95 is wound around the rotary shaft 90*b* to bias the support 90 in the counterclockwise direction in FIGS. 10A and 10B.

As a result, the weight load of the extended bottom plate 62 can be held by the force of the roller R pressing the lower face 62*b* of the extended bottom plate 62. When the extended bottom plate 62 vertically moves, the roller R at the upper end of the support 90 slides along the lower face 62*b* of the extended bottom plate 62 in the horizontal direction as the support 90 changes the angle of inclination. As a result, the parallelism in vertical movement of the extended bottom plate 62 can be maintained. The configuration of FIGS. 10A and 10B has the roller R on the lower side of the extended bottom plate 62, which prevents the roller R from being touched by hands. For this reason, the configuration of FIGS. 10A and 10B is a desirable configuration in view of user protection.

The lower face 62*b* of the extended bottom plate 62 has the strength that can stably support the roller R. On the other hand, the extended bottom plate 62 may be provided with a reinforcement member 62*c* on the lower face 62*b*, as illustrated in FIG. 10B. As a result, the durability of the lower face 62*b* of the extended bottom plate 62 can be enhanced.

Fifth Embodiment

Figure 11A:
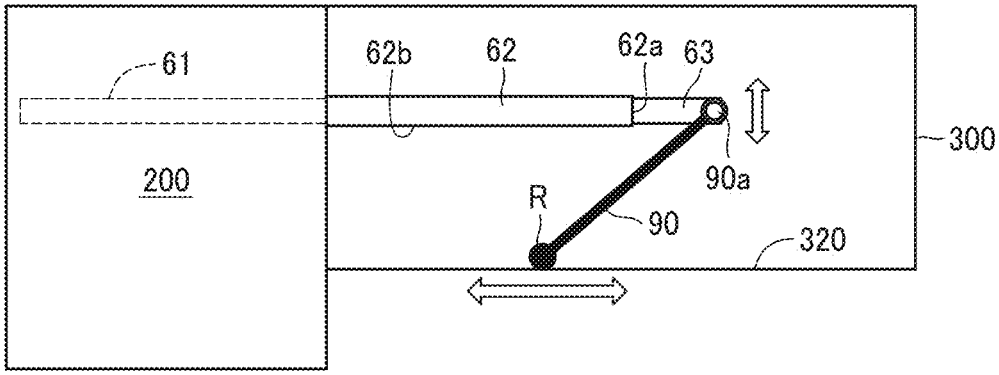
FIG. 11A is a schematic side view of the sheet feeding device and the additional casing, according to a fifth embodiment of the present disclosure.
Figure 11B:
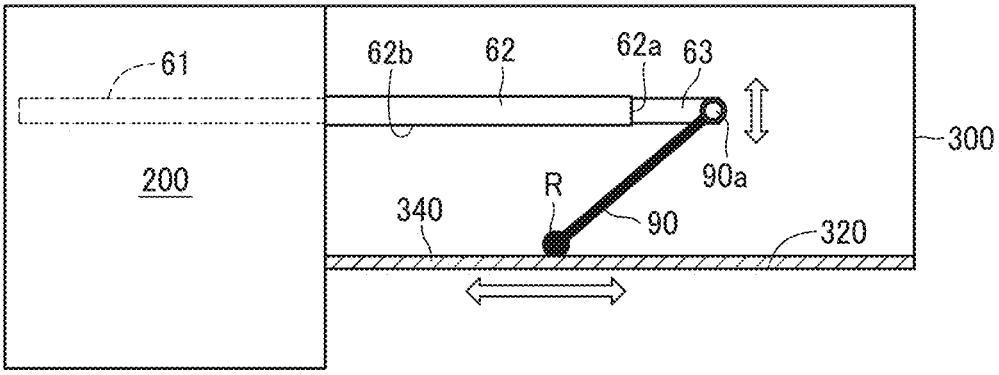
FIG. 11B is a schematic side view of the sheet feeding device and the additional casing, according to the fifth embodiment of the present disclosure, with a reinforcement member added to the additional casing.

A description is given of the sheet feeding device 200 according to the fifth embodiment of the present disclosure, with reference to FIGS. 11A and 11B.

FIG. 11A is a schematic side view of the sheet feeding device 200 and the additional casing 300, according to the fifth embodiment of the present disclosure.

FIG. 11B is a schematic side view of the sheet feeding device 200 and the additional casing 300, according to the fifth embodiment of the present disclosure, with a reinforcement member 340 added to the additional casing 300.

As illustrated in FIGS. 11A and 11B, in the fifth embodiment, a second extended bottom plate 63 is extendably coupled to the sheet feeding upstream end 62*a* of the extended bottom plate 62 to support the sheet feeding upstream end of the second extended bottom plate 63 by the support 90. Due to such a configuration, even if the extended bottom plate 62 is further extended with the second extended bottom plate 63, as the support 90 moves along with the movement of the second extended bottom plate 63, the support 90 can constantly support the rear end of the second extended bottom plate 63.

The one end (i.e., the upper end) of the support 90 is rotatably coupled to the sheet feeding upstream end of the second extended bottom plate 63 via the rotary shaft 90*a*. The roller R at the other end (the lower end) of the support 90 is supported by the bottom face 320 of the additional casing 300 below the extended bottom plate 62. In other words, the other end of the support 90 slidably contacts the bottom face 320 of the additional casing 300.

The torsion spring 95 is wound around the rotary shaft 90*a* to bias the support 90 in the counterclockwise direction in FIGS. 11A and 11B. As a result, the weight load of the extended bottom plate 62 and the second extended bottom plate 63 can be held by the reaction force of the roller R pressing the bottom face 320 of the additional casing 300.

When the extended bottom plate 62 and the second extended bottom plate 63 vertically move, the roller R at the lower end of the support 90 slides along the bottom face 320 of the additional casing 300 in the direction indicated by the horizontal arrow as the support 90 changes the angle of inclination. As a result, the parallelism in vertical movement of the extended bottom plate 62 can be maintained.

The additional casing 300 itself has the strength that can stably support the roller R. On the other hand, the additional casing 300 may be provided with the reinforcement member 340 on the bottom face 320, as illustrated in FIG. 10B. Accordingly, the durability of the bottom face 320 can be enhanced.

Sixth Embodiment

Figure 12A:
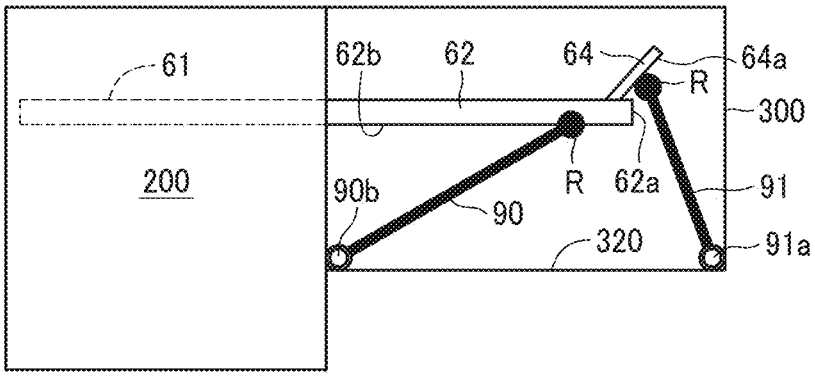
FIG. 12A is a schematic side view of the sheet feeding device and the additional casing, according to a sixth embodiment of the present disclosure.
Figure 12B:
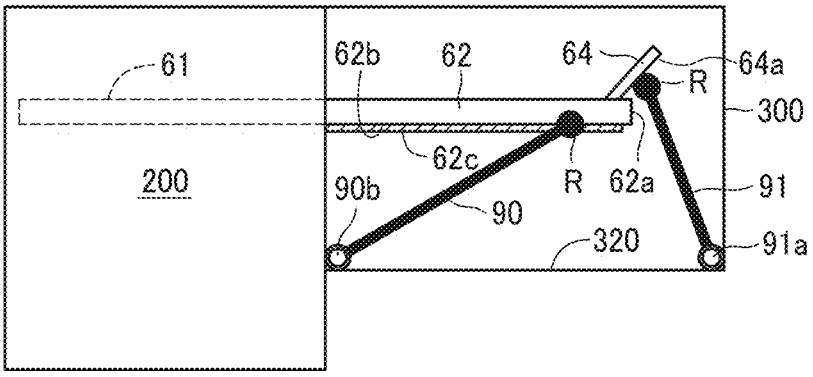
FIG. 12B is a schematic side view of the sheet feeding device and the additional casing, according to the sixth embodiment of the present disclosure, with a reinforcement member added to the extended bottom plate in the additional casing.

A description is given of the sheet feeding device 200 according to the sixth embodiment of the present disclosure, with reference to FIGS. 12A and 12B.

FIG. 12A is a schematic side view of the sheet feeding device 200 and the additional casing 300, according to the sixth embodiment of the present disclosure.

FIG. 12B is a schematic side view of the sheet feeding device 200 and the additional casing 300, according to the sixth embodiment of the present disclosure, with the reinforcement member 91 added to a third extended bottom plate 64 in the additional casing 300.

As illustrated in FIGS. 12A and 12B, in the sixth embodiment, the one end (i.e., the upper end) of the third extended bottom plate 64 is coupled to the sheet feeding upstream end of the extended bottom plate 62 to be rotatable in the vertical direction. The third extended bottom plate 64 can provide an angle to the trailing end of the sheet material. The sheet material angled at the trailing end can prevent air for sheet separation blown from the side air discharging port in each of the side fences from being leaked from the trailing end of the sheet material, resulting in enhancing the sheet separation performance and preventing no sheet feed error.

The third extended bottom plate 64 is supported by the reinforcement member 91. More specifically, one end (i.e., the lower end) of the reinforcement member 91 is coupled to the bottom face 320 of the additional casing 300 via the rotary shaft 91*a*, so that the roller R on the other end (i.e., the upper end) of the reinforcement member 91 (support) slidably contact the lower face 64*a* of the third extended bottom plate 64. The lower face 64*a* of the third extended bottom plate 64 serves as a sliding face of the roller R.

The torsion spring 95 is wound around the rotary shaft 91*a* to bias the reinforcement member 91 (support) in the counterclockwise direction in FIGS. 12A and 12B. As a result, the angle of rotation of the third extended bottom plate 64 can be held by the force of the roller R pressing the lower face 64*a* of the third extended bottom plate 64.

When the extended bottom plate 62 and the third extended bottom plate 64 vertically move, the roller R of the support 90 slides along the lower face 62*b* of the extended bottom plate 62 as the support 90 changes the angle of inclination and the roller R of the reinforcement member 91 (support) slides along the lower face of the third extended bottom plate 64 as the reinforcement member 91 (support) changes the angle of inclination. As a result, the parallelism in vertical movement of the extended bottom plate 62 can be maintained.

The lower face 62*b* of the extended bottom plate 62 has the strength that can stably support the roller R. On the other hand, the extended bottom plate 62 may be provided with the reinforcement member 62*c* on the lower face 62*b*, as illustrated in FIG. 12B. As a result, the durability of the lower face 62*b* of the extended bottom plate 62 can be enhanced.

Although several embodiments of the present disclosure have been described above, embodiments of the present disclosure are not limited to the embodiments described above, and a variety of modifications can naturally be made within the scope of the present disclosure.

The present disclosure is not limited to specific embodiments described above, and numerous additional modifications and variations are possible in light of the teachings within the technical scope of the appended claims. It is therefore to be understood that, the disclosure of this patent specification may be practiced otherwise by those skilled in the art than as specifically described herein, and such, modifications, alternatives are within the technical scope of the appended claims. Such embodiments and variations thereof are included in the scope and gist of the embodiments of the present disclosure and are included in the embodiments described in claims and the equivalent scope thereof.

The effects described in the embodiments of this disclosure are listed as the examples of preferable effects derived from this disclosure, and therefore are not intended to limit to the embodiments of this disclosure.

The embodiments described above are presented as an example to implement this disclosure. The embodiments described above are not intended to limit the scope of the invention. These novel embodiments can be implemented in various other forms, and various omissions, replacements, or changes can be made without departing from the gist of the invention. These embodiments and their variations are included in the scope and gist of this disclosure and are included in the scope of the invention recited in the claims and its equivalent.

Any one of the above-described operations may be performed in various other ways, for example, in an order different from the one described above.

What is claimed is:

1. An apparatus comprising:

an image forming apparatus;

a sheet feeding device comprising a sheet tray including a bottom plate and configured to feed a sheet placed on the bottom plate, toward the image forming apparatus, and an extended bottom plate extending outward from the sheet feeding device and coupled to an upstream end of the bottom plate of the sheet tray in a sheet conveyance direction in which the sheet is conveyed;

a casing attached to a side face of the sheet feeding device to cover the extended bottom plate;

a support disposed between an inner wall face of the casing and the extended bottom plate to support a weight load of the extended bottom plate; and a roller disposed in the casing, wherein the inner wall face of the casing is a front wall face of the casing in proximity to the sheet feeding device, and wherein one end of the support is fixed to the extended bottom plate and another end of the support slidingly contacts the front wall face of the casing via the roller.

2. The apparatus according to claim 1, wherein the support includes a rotary shaft, wherein the casing includes a bottom wall face below the extended bottom plate, wherein the one end of the support is slidably fixed to a lower face of the extended bottom plate via the roller and the rotary shaft, as another end of the support, is coupled to the inner wall face of the casing, and wherein a spring is wound around the rotary shaft to bias the roller toward the lower face of the extended bottom plate.

3. The apparatus according to claim 1, further comprising:

another extended bottom plate coupled to an upstream end of the extended bottom plate extending in the sheet conveyance direction to vertically rotate; and another support disposed between the inner wall face of the casing and said another extended bottom plate to support a weight load of said another extended bottom plate, wherein the support includes a rotary shaft, wherein the casing includes a bottom wall face below the extended bottom plate, wherein the one end of the support is slidably fixed to a lower face of the extended bottom plate via the roller and the rotary shaft, as another end of the support, is coupled to the inner wall face of the casing, and wherein a spring is wound around the rotary shaft to bias the roller toward the lower face of the extended bottom plate.

4. The apparatus according to claim 1, further comprising a reinforcement member disposed on a sliding face on which the roller slides.

5. The apparatus of claim 1 wherein the image forming apparatus is adjacent to the sheet feeding device.

6. An apparatus comprising:

a sheet feeding device comprising a sheet tray including a bottom plate and configured to feed a sheet placed on the bottom plate, toward an image forming apparatus, and an extended bottom plate extending outward from the sheet feeding device and coupled to an upstream end of the bottom plate of the sheet tray in a sheet conveyance direction in which the sheet is conveyed;

a casing attached to a side face of the sheet feeding device to cover the extended bottom plate;

a support disposed between an inner wall face of the casing and the extended bottom plate to support a weight load of the extended bottom plate; and a roller disposed in the casing, wherein the support includes a rotary shaft, wherein the casing includes a bottom wall face below the extended bottom plate, wherein the inner wall face of the casing is the bottom wall face of the casing, wherein the rotary shaft, as one end of the support, is coupled to the extended bottom plate and another end of the support slidably contacts the bottom wall face of the casing via the roller, and wherein a spring is wound around the rotary shaft to bias the roller toward the bottom wall face of the casing.

7. The sheet feeding device according to claim 6, wherein the extended bottom plate includes another extended bottom plate coupled to an upstream end of the extended bottom plate extending in the sheet conveyance direction, wherein the rotary shaft, as one end of the support, is coupled to said another extended bottom plate and another end of the support contacts the bottom wall face of the casing via the roller.

8. The sheet feeding device according to claim 6, further comprising:

another extended bottom plate coupled to an upstream end of the extended bottom plate extending in the sheet conveyance direction to vertically rotate; and another support disposed between the inner wall face of the casing and said another extended bottom plate to support a weight load of said another extended bottom plate.

9. The sheet feeding device according to claim 6, further comprising a reinforcement member disposed on a sliding face on which the roller slides.

10. An apparatus comprising:

a sheet feeding device comprising a sheet tray including a bottom plate and configured to feed a sheet placed on the bottom plate, toward an image forming apparatus, and an extended bottom plate extending outward from the sheet feeding device and coupled to an upstream end of the bottom plate of the sheet tray in a sheet conveyance direction in which the sheet is conveyed;

a casing attached to a side face of the sheet feeding device to cover the extended bottom plate;

a support disposed between an inner wall face of the casing and the extended bottom plate to support a weight load of the extended bottom plate; and a roller disposed in the casing, wherein the support includes a rotary shaft, wherein the inner wall face of the casing is a face of each of opposed side walls of the casing at both sides of the extended bottom plate, wherein the rotary shaft, as one end of the support, is coupled to the extended bottom plate and another end of the support slidably contacts the face of each of the opposed side walls of the casing via the roller, and wherein a spring is wound around the rotary shaft to bias the roller downward.

11. The sheet feeding device according to claim 10, wherein the extended bottom plate includes another extended bottom plate coupled to an upstream end of the extended bottom plate extending in the sheet conveyance direction, wherein the rotary shaft, as one end of the support, is coupled to said another extended bottom plate and another end of the support contacts the inner wall face of the casing via the roller.

12. The sheet feeding device according to claim 10, further comprising:

another extended bottom plate coupled to an upstream end of the extended bottom plate extending in the sheet conveyance direction to vertically rotate; and another support disposed between the inner wall face of the casing and said another extended bottom plate to support a weight load of said another extended bottom plate, wherein one end of the support slidably contacts a lower face of the extended bottom plate via the roller and the rotary shaft, as another end of the support, is coupled to the inner wall face of the casing.

13. The sheet feeding device according to claim 10, further comprising a reinforcement member disposed on a sliding face on which the roller slides.

* * * * *